US005607339A

United States Patent [19]

Kramer

[11] Patent Number: 5,607,339

[45] Date of Patent: Mar. 4, 1997

[54] BATH TOY AND A METHOD OF USE OF THE SAME

[76] Inventor: Colleen A. Kramer, 4204 - 52 Avenue, Beaumont, Alberta, Canada, T4X 1J4

[21] Appl. No.: 278,333

[22] Filed: Jul. 21, 1994

[51] Int. Cl.[6] ..... A63H 33/00; A63H 23/00; A63H 3/08

[52] U.S. Cl. ..... 446/491; 446/153; 446/387; 273/DIG. 5

[58] Field of Search ..... 446/491, 98, 97, 446/101, 153, 387, 490, 901; 273/DIG. 5, 282.2

[56] References Cited

U.S. PATENT DOCUMENTS

| | | | |
|---|---|---|---|
| 2,586,017 | 2/1952 | Freedman . | |
| 2,592,078 | 4/1952 | Taylor et al. . | |
| 3,274,706 | 9/1966 | Friend | 446/901 X |
| 3,568,356 | 3/1971 | Berman | 446/98 X |
| 3,701,214 | 10/1972 | Sakamoto | 273/DIG. 5 X |
| 3,762,709 | 10/1973 | Roloff et al. | 273/404 |
| 3,836,151 | 9/1974 | Bowerman . | |
| 3,870,591 | 3/1975 | Witman | 273/DIG. 5 X |
| 3,962,507 | 6/1976 | McCreary et al. | 273/DIG. 5 X |
| 4,297,153 | 10/1981 | Erickson et al. | 273/DIG. 5 X |
| 4,336,664 | 6/1982 | Penick et al. . | |
| 4,496,327 | 1/1985 | Bennett . | |
| 4,536,423 | 8/1985 | Travis . | |
| 4,652,239 | 3/1987 | Brimberg . | |
| 4,714,275 | 12/1987 | Engel et al. . | |
| 4,900,604 | 2/1990 | Martinez et al. . | |
| 5,044,957 | 9/1991 | Kuranaga | 273/DIG. 5 X |

OTHER PUBLICATIONS

"Colorforms" Trademark Registration, Dec. 10, 1963, with Certificate of Renewal. Example of Colorform Kit element. Popular Mechanics Magazine, published Dec. 1949 vol. 92, No. 6, p. 139—"Stick Ons" for Children.

*Primary Examiner*—Sam Rimell
*Assistant Examiner*—D. Neal Muir
*Attorney, Agent, or Firm*—Anthony R. Lambert

[57] ABSTRACT

A bath toy is described which consists of a small distinctive play shape suitable for play by children formed from a flexible sheet of polymer plastic material between 2 mm and 6 mm in thickness. The sheet material has a modulus of elasticity of less than 750 pounds per square inch. The weight of the play shape is less than the supporting effect of a thin layer of water spread evenly over its surface area.

2 Claims, 3 Drawing Sheets

BATH TOY AND A METHOD OF USE OF THE SAME

The present invention relates to a bath toy and a method of use of the same.

BACKGROUND OF THE INVENTION

Bath toys are used by children when having a bath. They differ from other toys in that the presence of water is necessary to make full use of the toy. For example, a floatation toy has buoyant properties which cannot be utilized unless the toy is placed in water. Unfortunately, there are a limited number of toys which interact with water.

SUMMARY OF THE INVENTION

What is required is a new genre of bath toy that interacts with water to enable a child to play in the bath tub.

According to one aspect of the present invention there is provided a bath toy which is comprised of a small distinctive play shape suitable for play by children formed from a flexible sheet of polymer plastic material between 2 mm and 6 mm in thickness. The sheet material has a modulus of elasticity of less than 750 pounds per square inch. The weight of the play shape is less than the supporting effect of a thin layer of water spread evenly over its surface area.

It is preferred that the bath toy consist of a plurality of distinctive shapes. Although there are an infinite variety of distinctive shapes possible, one example would be a theme such as "home". With this theme the sheet material would be cut into the shape of a house, a car, a tree, and like objects that are familiar to the child from his home experiences. Another example, would be a doll with clothes which can be placed on the doll to "dress" the doll. Another example, would be a plurality of interlocking shapes which form a puzzle.

According to another aspect of the invention there is provided a method of using water impervious sheet material as a bath toy. Firstly, wet a small distinctive play shape suitable for play by children formed from a flexible sheet of polymer plastic material between 2 mm and 6 mm in thickness. The sheet material has a modulus of elasticity of less than 750 pounds per square inch. The weight of the play shape is less than the supporting effect of a thin layer of water spread evenly over its surface area. Secondly, place the play shape onto a water impervious mounting surface such that the thin layer of water trapped between the polymer plastic material and the mounting surface causes the play shape to adhere to the mounting surface.

A preferred method involves the a particular toy which is in the form of a doll. A child during play can dress the doll, with clothing. Firstly, wet a doll formed from a flexible sheet of polymer plastic material between 2 mm and 6 mm in thickness and having a surface tension substantially equal to that of water. The sheet material has a modulus of elasticity of less than 750 pounds per square inch. The weight of the doll is less than the supporting effect of a thin layer of water spread evenly over its surface area. Secondly, place the doll onto a water impervious mounting surface such that the thin layer of water trapped between doll and the mounting surface causes the doll to adhere to the mounting surface. Thirdly, wet clothes formed from flexible sheet-form overlays of polymer plastic material between 2 mm and 6 mm in thickness and having a surface tension substantially equal to that of water. The sheet material has a modulus of elasticity of less than 750 pounds per square inch. The weight of the clothes is less than the supporting effect of a thin layer of water spread evenly over its surface area. Fourthly, place the clothes onto the doll such that the thin layer of water trapped between the clothes and the doll causes the clothes to adhere to the doll.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

A method of using water impervious sheet material as a bath toy will now be described .with reference to FIGS. 1 through 3.

The method in its most basic form consists of two steps. Firstly, wetting sheet material. Secondly, placing the sheet material onto a mounting surface such that a thin layer of water is trapped between the sheet material and the mounting surface whereby the sheet material adheres to the mounting surface as a result of surface tension. This basic method will now be illustrated with three examples of bath toys constructed in accordance with the teachings of the method.

Figure 1:
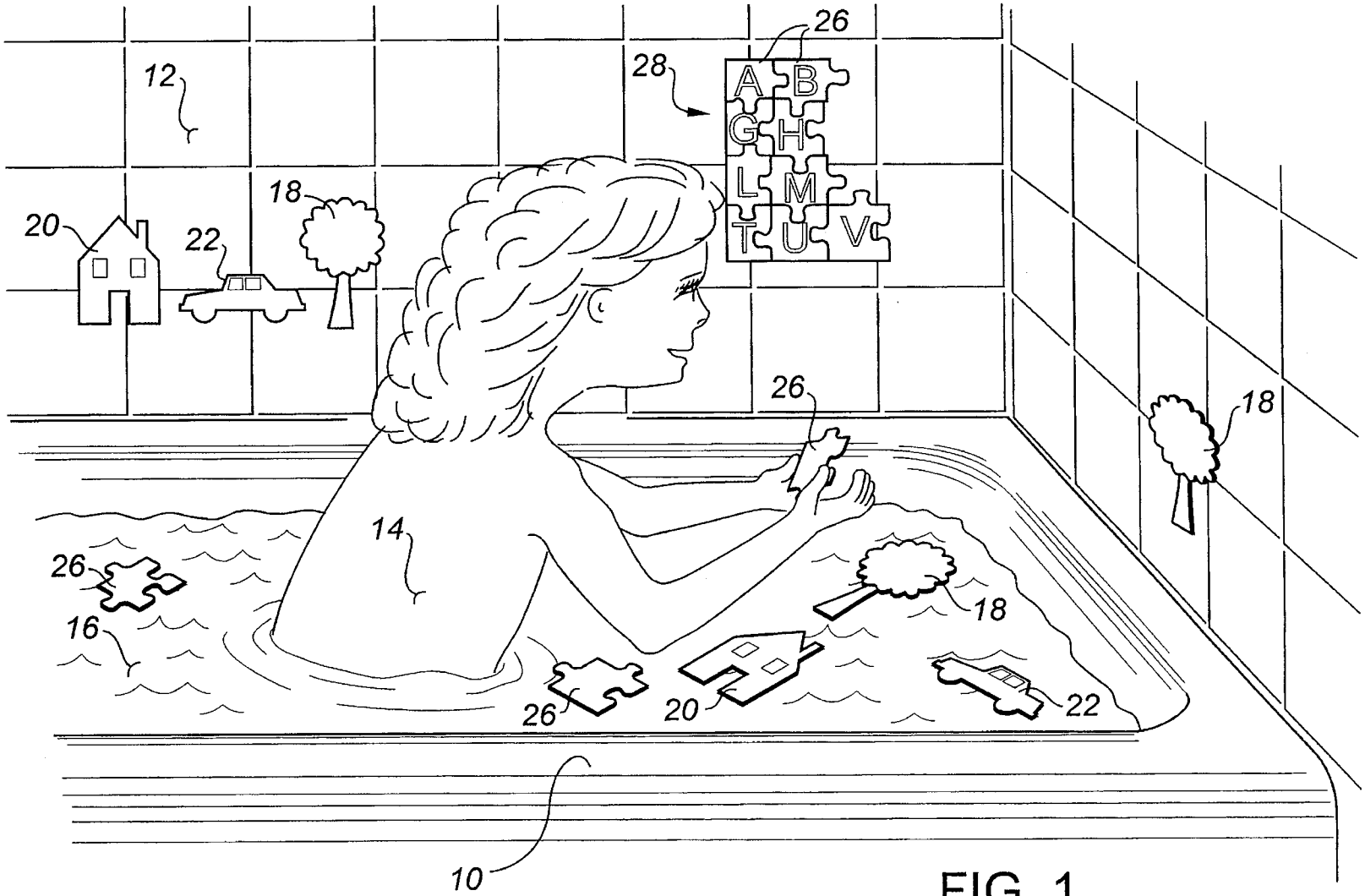
FIG. 1 is a perspective view illustrating a method of using water impervious sheet material as a bath toy in accordance with the present invention.
Figure 2:
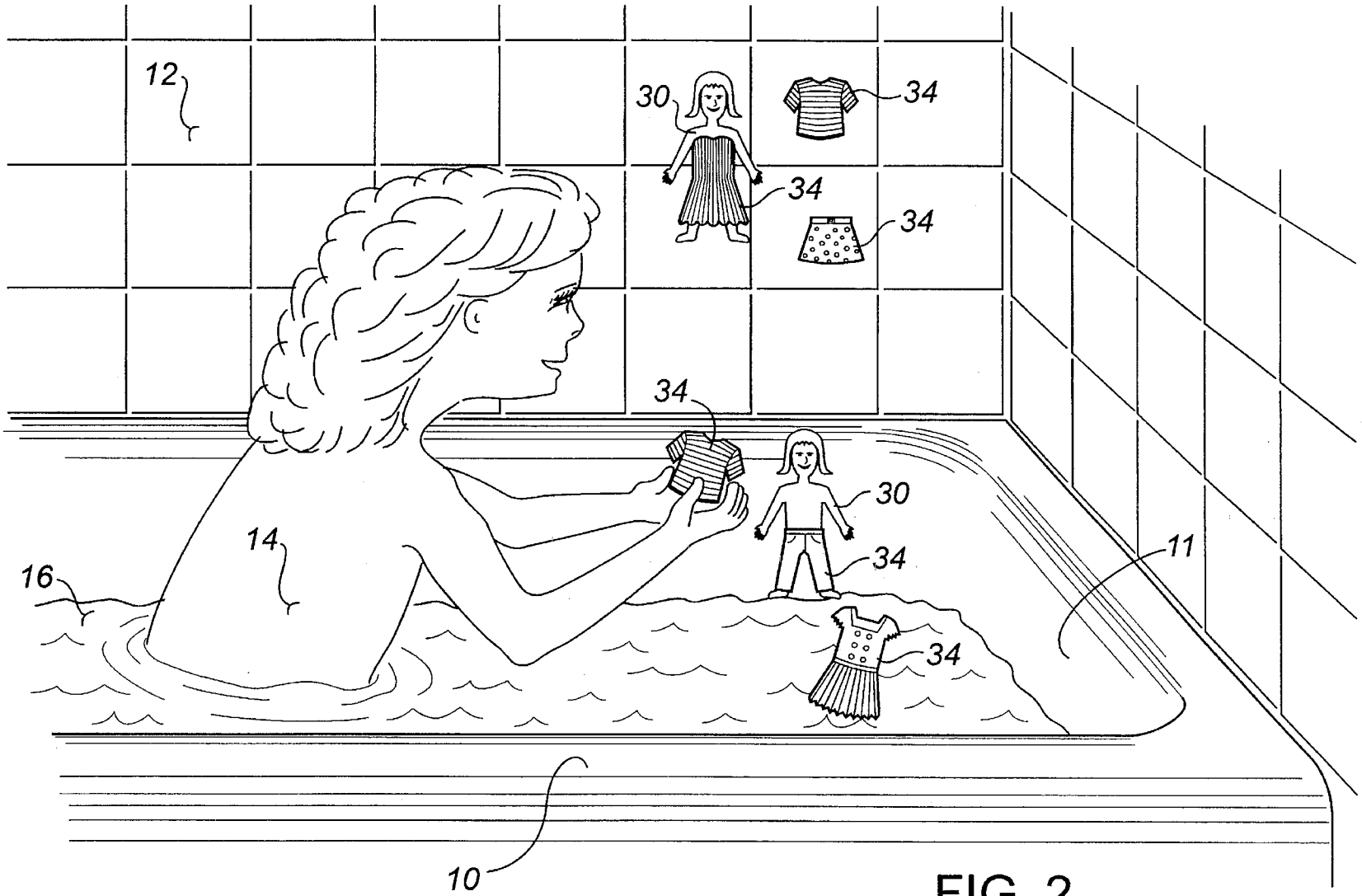
FIG. 2 is a perspective view illustrating a method of using water impervious sheet material as a bath toy in accordance with the present invention.
Figure 3:
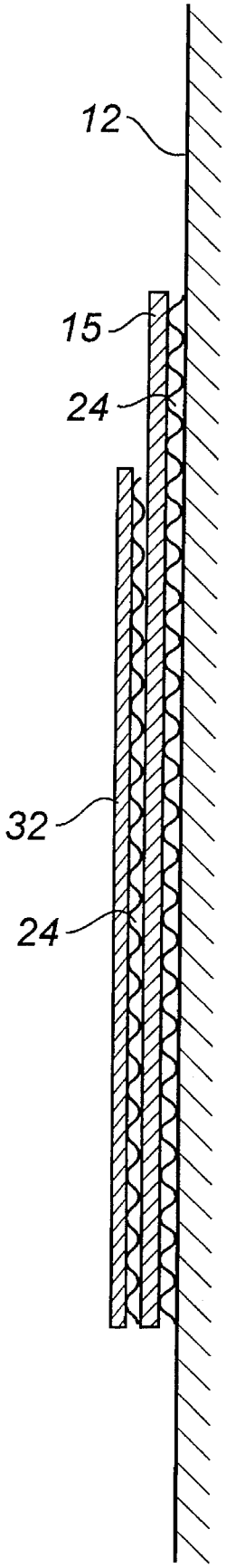
FIG. 3 is a section view illustrating the method illustrated in FIGS. 1 and 2.

FIGS. 1 and 2, illustrate a typical bath environment. There is a bath tub 10 with circumferential sidewalls 11. A tile wall 12 is positioned adjacent bath tub 10. A child 14 is pictured in bath tub 10, and bath tub 10 is filled with water 16.

Referring to FIG. 1, Firstly, water impervious sheet material 15 is cut into distinctive shapes suitable for play by children. The shapes of sheet material 15 illustrated are a tree 18, a house 20, and a car 22. Secondly, the tree 18, house 20 and car 22 are placed in water 16 so they get wet. It will be noted that they float. Thirdly, tree 18, house 20 and car 22 are placed onto a mounting surface such as sidewall 11 of bath tub 10 or tile wall 12. Referring to FIG. 3, regardless of shape, when sheet material 15 is placed on tile wall 12, a thin layer of water 24 is trapped between sheet material 15 and tile wall 12. This causes sheet material 15 to adhere to tile wall 12 by means of surface tension.

Referring to FIG. 1, another example of a bath toy according to the present method is illustrated in which sheet material 15 is cut into a plurality of interlocking pieces 26 of distinctive shapes forming a puzzle, generally indicated by reference numeral 28. Interlocking pieces 26 are placed in water 16 of bath tub 10 so they get wet. Interlocking pieces 26 of sheet material 15 adhere to tile wall 12 as a result of surface tension, as previously described.

Referring to FIG. 2, another example of a bath toy according to the present method is illustrated. Firstly water impervious sheet material 15 is cut into the shape of a doll 30. Secondly, doll 30 is wet, preferably by placing in water 16 of bath tub 10. Thirdly, doll 30 is placed onto a mounting surface, such as tile wall 12. Referring to FIG. 3, thin layer of water 24 is trapped between sheet of material 15 forming doll 30 and tile wall 12. Doll 30 adheres to tile wall 12 as a result of surface tension. Fourthly, referring to FIG. 2, cut a plurality of sheet-form overlays 32 in the form of clothes 34 for doll 30. Fifthly, wet clothes 34. Sixthly, place clothes 34 onto doll 30. Referring to FIG. 3, thin layer of water 24 is trapped between sheet-form overlays 32 forming clothes 34 and sheet material 15 forming doll 30. Clothes 34 adhere to doll 30 as a result of surface tension.

In order to function, as described, the weight of the play shape must be less than the supporting effect of a thin layer of water spread evenly over its surface area. In addition, the material must be flexible. Flexibility affects the ability to adhere, especially to sidewall 11 of bath tub 10 which has a curvature. The sheet material must have a modulus of elasticity of less than 750 pounds per square inch. It has been found that if the modulus of elasticity exceeds that amount, the time duration of adhesion is reduced to an extent that it is not practical for use as a bath toy. It has also been found that if the modulus of elasticity exceeds that amount the bath toy will not adhere at all to any surface with a curvature. In fact, the material will spring away from any curvature. It is preferred that the material selected have a surface tension substantially equal to that of water.

The bath toy described is intended primarily for use by preschool infants. The manual dexterity of infants is not fully developed. There are numerous thin membrane materials that meet all the above described qualities relating to elasticity and ability to adhere by means of surface tension and yet are unsuitable for use as a bath toy. Thin materials are not easily handled by the infants. On the other hand, as the thickness of materials increases the length of time that they can adhere by means of surface tension is reduced. It has been found that the useful range for use as a bath toy is between 2 mm and 6 mm in thickness. Another factor in the selection of the thickness of material relates to the fact that preschool infants have a tendency to place objects into their mouth, especially when teething. The bath toy must be able to take biting, and other abuse to which it will be subjected without pieces tearing off which could be swallowed or potentially choke the child. When the bath toy is in the form of a doll, the limbs of the doll must be able to take abuse without tearing off, as previously described, or stretching. Stretching deforms the surface of the doll and adversely affects the ability of the doll to adhere by means of surface tension. It will be understood that material of less than 2 mm in thickness is unsuitable for use as a puzzle as described, for there is not enough material for the pieces to interlock and portions of the pieces will tend to tear. Another disadvantage of thin materials is that they tend to build up a static charge. The preferred material is polyvinylchloride with a foam backing.

It will be apparent to one skilled in the art that modifications may be made to the illustrated bath toys without departing from the spirit and scope of the invention as defined by the claims.

The embodiments of the invention in which an exclusive property or privilege is claimed are defined as follows:

1. In combination:

a water retaining enclosure having sidewalls;

water in the water retaining enclosure; and a bath toy, comprising:

a small distinctive play shape suitable for play by children formed from a flexible sheet of polymer plastic material between 2 mm and 6 mm in thickness and a modulus of elasticity of less than 750 pounds per square inch, the weight of the play shape being less than the supporting effect of a thin layer of water spread evenly over its surface area, such that the bathtoy adheres to the sidewalls of the water retaining enclosure.

2. The combination as defined in claim 1 wherein the polymer plastic material of the bath toy has a surface tension substantially equal to that of water.

* * * * *